US008307891B2

(12) United States Patent
Bishop et al.

(10) Patent No.: US 8,307,891 B2
(45) Date of Patent: Nov. 13, 2012

(54) RETRACTABLE DOWNHOLE BACKUP ASSEMBLY FOR CIRCUMFERENTIAL SEAL SUPPORT

(75) Inventors: David S. Bishop, Houston, TX (US); James C. Doane, Friendswood, TX (US); Dennis E. Kroll, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 241 days.

(21) Appl. No.: 12/857,745

(22) Filed: Aug. 17, 2010

(65) Prior Publication Data

US 2011/0036561 A1 Feb. 17, 2011

Related U.S. Application Data

(63) Continuation-in-part of application No. 12/361,352, filed on Jan. 28, 2009, now Pat. No. 7,806,177.

(51) Int. Cl.
*E21B 33/128* (2006.01)

(52) U.S. Cl. ..... 166/134

(58) Field of Classification Search ..... 166/387, 166/118, 134, 191
See application file for complete search history.

(56) References Cited

U.S. PATENT DOCUMENTS 2,715,441 A 8/1955 Bouvier
4,311,196 A 1/1982 Beall et al.
5,209,522 A 5/1993 Reaux
5,342,066 A 8/1994 Henley et al.
5,487,427 A 1/1996 Currington
5,542,473 A 8/1996 Pringle
5,701,959 A 12/1997 Hushbeck et al.
6,167,963 B1 1/2001 McMahan et al.
6,695,050 B2 2/2004 Winslow et al.
6,827,150 B2 12/2004 Luke
7,114,559 B2 10/2006 Sonnier et al.
7,222,669 B2 5/2007 Sonnier et al.
7,290,603 B2 11/2007 Hiorth et al.
7,614,449 B2 11/2009 Anderson
7,665,516 B2 2/2010 Roberts et al.
7,669,665 B2 3/2010 Millet et al.

(Continued)

OTHER PUBLICATIONS

BTU, HPHT Retrievable Packer/Plug; Bronnteknologiutvikling, 2005, 1 page.

(Continued)

*Primary Examiner* — William P Neuder
(74) *Attorney, Agent, or Firm* — Steve Rosenblatt

(57) ABSTRACT

Wedge shaped elements form a ring structure that can increase in diameter for a grip using relative axial motion of adjacent segments. The adjacent seal is further separated from access to the edges of the adjacent segments that move relatively by ring segments attached to the wide dimension of the segments that face the seal. The ring segments move out with the wedge elements to which they are attached so that in the set position of the seal there is an enhanced barrier against the surrounding tubular with the ring segments. The ring segments further block access of the seal under compressive loading to the interface locations between the wedge shaped elements so that their relative axial movement does not trap a portion of the seal and initiate cracks in the seal that can lead to leakage past the seal.

22 Claims, 9 Drawing Sheets

U.S. PATENT DOCUMENTS

| | | | | |
|---|---|---|---|---|
| 7,806,177 | B2 * | 10/2010 | Bishop et al. | 166/134 |
| 2003/0042027 | A1 | 3/2003 | Lang et al. | |
| 2003/0155118 | A1 | 8/2003 | Sonnier et al. | |
| 2003/0188862 | A1 | 10/2003 | Streich et al. | |
| 2004/0036225 | A1 | 2/2004 | Ritter et al. | |
| 2008/0264627 | A1 | 10/2008 | Roberts et al. | |
| 2009/0126925 | A1 | 5/2009 | Guest et al. | |
| 2010/0101807 | A1 | 4/2010 | Greenlee et al. | |
| 2010/0186947 | A1 | 7/2010 | Bishop et al. | |

OTHER PUBLICATIONS

Makenzie, Gordon R.J., et al., "Hydraulics As It Affects Our Tools—The Inflatable Paradox", SPE 89537, Mar. 2004, 1-7.

Coronado, Martin P., "Development of an Internal Coiled Tubing Connector Utilizing Permanent Packer Technology", SPE 46036, Apr. 1998, 139-148.

Chapman, I.C., et al., Wireline Deployed Metal Sealing Bridge Plug System: Operational Learning Curve and Subsequent Redevelopment SPE 113891, April 1-13, 2008.

* cited by examiner

RETRACTABLE DOWNHOLE BACKUP ASSEMBLY FOR CIRCUMFERENTIAL SEAL SUPPORT

RELATED APPLICATION DATA

This is a continuation in part of application Ser. No. 12/361,352 filed Jan. 28, 2009 entitled "Retractable Downhole Backup Assembly for Circumferential Seal Support."

FIELD OF THE INVENTION

The field of the invention is downhole backup devices for seals and more particularly devices that are retractable and positioned between seals for protection from well fluids and protection of the surrounding tubular from incremental stress from applied pressure differentials and most particularly to segmented slip segments that form a support ring and end treatment for such ring adjacent a seal to minimize seal damage from relative axial slip segment movements.

BACKGROUND OF THE INVENTION

Packers are used downhole to isolate zones in a wellbore. Many styles of packers are in use depending on the application and well conditions. A common design uses an annularly shaped sealing element that is axially compressed by setting down weight, or a setting tool that holds a mandrel and pushes down on a setting sleeve or a hydraulic mechanism that involves blocking a path through the packer and building pressure on a piston assembly to compress the sealing element. When the sealing element is compressed axially it extends radially into a sealing relationship with the surrounding tubular. To enhance the grip of the extended element there is also an upper and a lower set of slips disposed on opposed sides of the sealing element. The slips generally comprise tapered segments with exterior wickers that bite into the surrounding tubular when ramped out on tapered surfaces during the process of axially compressing the sealing element.

One issue with the compression set sealing elements is extrusion in the uphole or the downhole directions. Frequently, anti-extrusion rings are placed at the opposed ends of the sealing element. They plastically deform when the sealing element is axially compressed and engage the surrounding tubular to create a barrier at opposed ends. The problem with anti-extrusion rings is when the packer is retrieved. The plastically deformed rings retain their deformed shape despite extension of the packer mandrel assembly that allows the sealing element to extend axially and radially retract. In essence, the backup rings can still be in contact with the surrounding tubular after the sealing element has retracted away from the backup rings in a radial and an axial direction. When the packer is pulled out in this condition, the backup rings can swab the well as the packer is removed. Swabbing is the act of reducing pressure by removal of a tool that seals as it is being retrieved. This swabbing can cause formation damage or lead to the well coming in and a potential loss of well control. Also, well fluid above the packer is displaced upward or through a small bypass in the tool. This condition severely limits retrieval speed. Another problem is that the backup rings can get mangled on the trip out of the hole and cause the packer to hang up and in severe cases the packer may have to be milled to remove it.

Traditional designs have slips above and below the sealing element. A problem with this design is that when in service, and exposed to pressure differentials acting on the mandrel with the packer set there is a transfer of the applied pressure differential to the wickers of the uphole slips if the differential pressure is in the uphole direction and on the downhole slips if the pressure differential is in the downhole direction. This arrangement creates added stress on the surrounding tubular from the force increment on the slips created by the applied pressure differential.

There is yet another issue with debris in the well such as sand or gravel settling on top of the anti-extrusion rings, thus making it difficult to extract the packer after release.

Extrusion barriers different from continuous pliable rings that plastically deform have been tried. The idea behind a segmented ring design is the ability to maintain an overlapping relationship of the segments as they are ramped out on a tapered surface. This design is illustrated in U.S. Pat. No. 7,290,603. The problem with this design that used long return springs in the hope of biasing the segments to retract is twofold. The long spring members are exposed and can get damaged during run in. The debris in the well can get on the ramp surface or under the long spring elements and prevent the segments from retracting. This design also transfers load from differential pressure into the slips to increase stress in the surrounding tubing wall.

What is needed is an anti-extrusion system that is protected from well fluid debris after it is set while also minimizing the forces created from pressure differentials while in service from further stressing the surrounding tubular. An improved retraction system for a fully circumferential extrusion barrier is also provided to a barrier shielded from well fluids between seals. The barrier elements can have external wickers and function as slips as well as a barrier. The elements can also have a ring segment mounted to their wide dimension where the ring segments span over the region where the elements move relatively in the axial direction to change diameter. In the gripping position the seal is further isolated from exposure to relatively moving segments that can damage the seal. These and other features of the present invention will become more readily apparent to those skilled in the art from a review of the description of the preferred embodiment below along with the associated drawings, while recognizing that the full scope of the invention is to be found in the literal and equivalent scope of the appended claims.

SUMMARY OF THE INVENTION

A packer features spaced apart sealing elements with an extrusion barrier between them. When the packer is set the extrusion barrier is protected from debris in the well. The barrier provides full circumferential extrusion protection using one or more rings made of wedge shaped segments that have a keyway at their edges and are assembled in an alternating manner so as to be able to increase or decrease in diameter when mandrel components are moved toward or away from each other. The segments have an opening through which a mandrel projection extends so as to force the segments into the smaller diameter for removal. Travel stops for the segments in the form of machined flats are provided on the relatively movable mandrel components.

In a variation, the wedge shaped elements form a ring structure that can increase in diameter for a grip using relative axial motion of adjacent segments. The adjacent seal is further separated from access to the edges of the adjacent segments that move relatively by ring segments attached to the wide dimension of the segments that face the seal. The ring segments move out with the wedge elements to which they are attached so that in the set position of the seal there is an enhanced barrier against the surrounding tubular with the ring segments. The ring segments further block access of the seal under compressive loading to the interface locations between the wedge shaped elements so that their relative axial movement does not trap a portion of the seal and initiate cracks in the seal that can lead to leakage past the seal.

DETAILED DESCRIPTION OF THE PREFERRED EMBODIMENT

Figure 1:
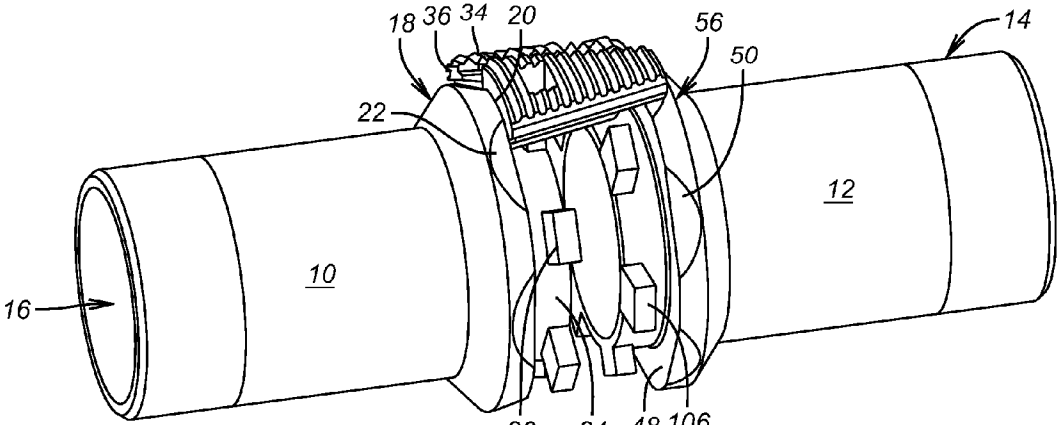
FIG. 1 is a perspective view of mandrel components that move relatively to actuate the segments of the backup system between retracted and extended positions.
Figure 5:
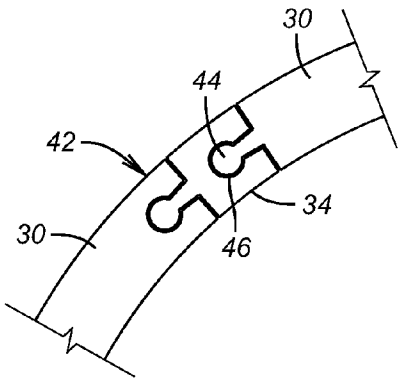
FIG. 5 shows the edge interface between adjacent segments of opposed orientation.

FIG. 1 illustrates the elements of the backup system that can be used downhole in a variety of applications and configurations, as will be explained below. While a given downhole tool will have many other components to accomplish its intended purpose, the basic components of operation of the backup system of the present invention are relatively movable components 10 and 12 that are part of a mandrel assembly 14 with a through passage 16. Component 10 has a fully circumferential exterior ring 18 with a radial pushing segmented surface 20 interrupted by tapered flats 22. A lower hub 24 extends beyond ring 18 and has a plurality of radial projections 26 that are preferably rectangular in cross-section, although other shapes can be used. The spacing on the projections is such that they line up with openings 28 on tapered segments 30 that have their noses 32 pointing in the same direction. Between segments 30 are tapered segments 34 that have their noses 36 pointing in the opposite direction from noses 32. Preferably noses 32 and 36 have a rounded profile so that when the set position is obtained in a packer application seen in FIG. 2 there will not be damage to the sealing elements 38 and 40 that preferably are disposed on opposed sides of the circumferential ring 42 a part of which is shown on an end view in FIG. 5 to show how segments 30 and 34 can be secured on their edges as they slide axially with respect to each other which results in the diameter changing in opposed directions when components 10 and 12 are moved axially with respect to each other. A ball 44 extends into a socket 46 of an adjacent segment edge. Other edge retention devices such as dovetailed L-shapes that permit relative axial sliding on abutting edges while holding the overall ring shape 42 are contemplated to be within the scope of the invention.

Figure 2:
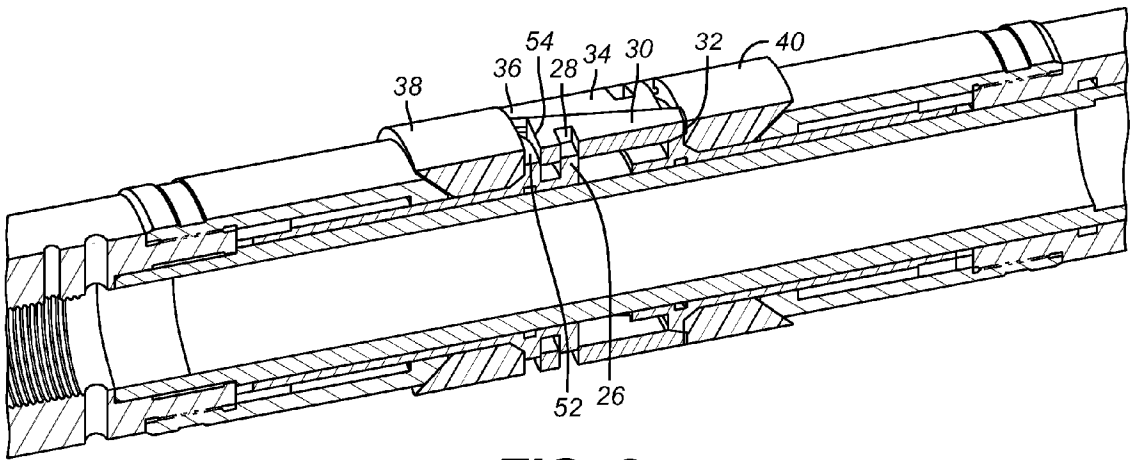
FIG. 2 is a part cutaway view of an application of the backup system of claim 1 to a packer with multiple seals where the backup system is between the seals.
Figure 3:
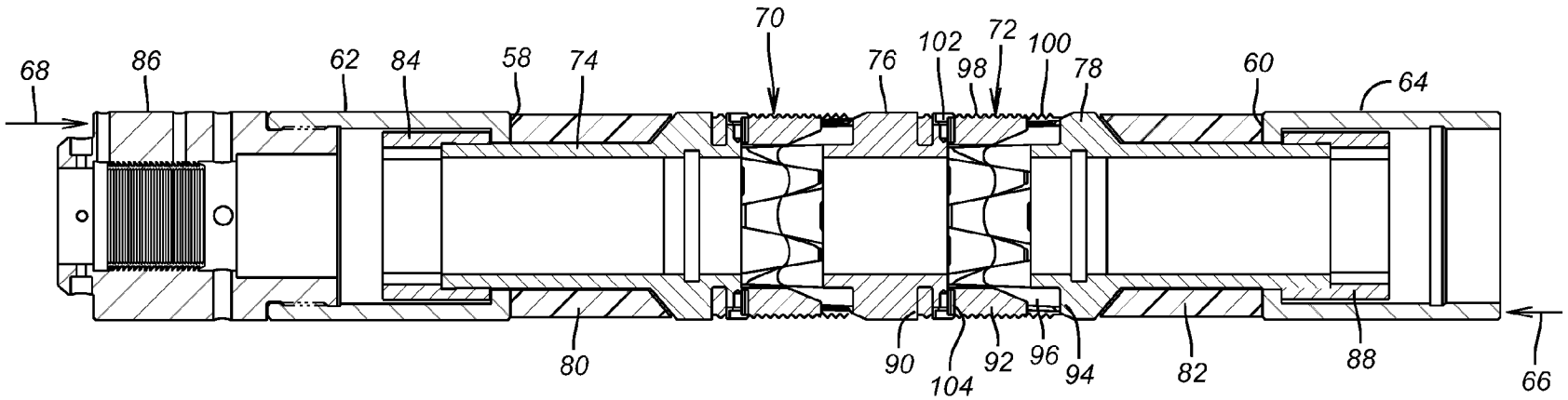
FIG. 3 is an alternative embodiment using two segmented ring backup systems that double as slips shown between seals and in the run in position.
Figure 4:
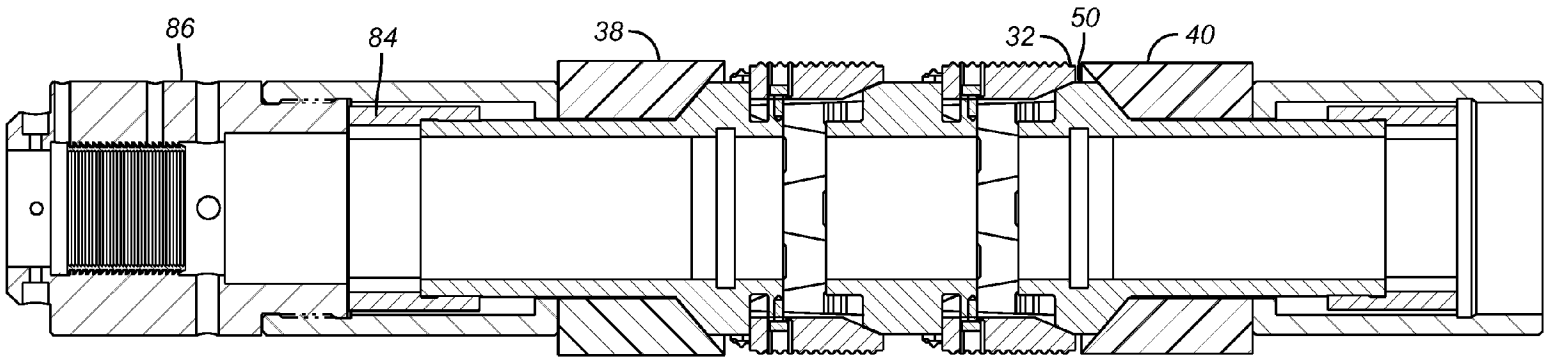
FIG. 4 is the view of FIG. 3 shown in the set position.

Segment 12 is preferably identical to segment 10 and oriented in a mirror image as shown in FIG. 1. Segment 12 has a radial pushing surface 48 to abut segments 34 to push them in the opposite direction as radial surface 20 pushes segments 30 that are oppositely oriented from segments 34. Radial surface 48 is interrupted by tapered flats 50. When components 10 and 12 are pushed together, noses 32 ride over flats 50, as best seen in FIG. 4 showing an alternative embodiment, with a minimal clearance such as about 0.015 inches. Similarly noses 36 ride over flats 22 with a similar clearance. The reason for the minimal clearance is to close off an extrusion route for the seal such as 40 in the set position. As best seen in FIG. 2, there is a series of axial gaps 52 between the tops 54 of segments 30 and the adjacent seal 38 interspersed with noses 36 and the same pattern exists at the opposite end between noses 32 and seal 40. However, axially between noses and an adjacent seal there is no place for extrusion as the tops such as 54 of the opposite oriented segment that is between the noses closes off any extrusion gaps by abutting against ring 18 on one side or ring 56 on the other. The noses 32 or 36 overly the flats 50 and 22 respectively in the set position against a surrounding tubular (not shown) with minimal clearance so that extrusion gaps for seals 38 or 40 are also effectively non-existent being so small. As a result full 360 degree extrusion protection is obtainable in the set position of FIG. 2 for the ends of the seals 38 and 40 that face each other. The outside ends 58 and 60 better seen in FIG. 3 abut sleeves 62 and 64 that are brought closer to each other when acted on by a setting tool shown schematically as arrows 66 and 68. Those skilled in the art will appreciate that other parts have been left out for clarity such as body lock rings to hold a set position after the setting tool 66, 68 sets and automatically releases. To prevent extrusion past ends 58 and 60 when setting, there is a limit to the amount of axial movement of sleeve 62 with respect to sleeve 64. The embodiment shown in FIGS. 3 and 4 illustrates the modular nature of the backup system and uses two rings with opposed segments 70 and 72. It has three spaced mandrel components as opposed to the two components 10 and 12 shown in FIG. 2 when only one backup ring is used. Instead, in FIG. 3 there are mandrel components 74, 76 and 78 that are spaced apart and relatively movable with respect to each other in response to operation of the setting tool 66, 68 for setting and in the opposite direction for removal with a known removal tool that extends the components away from each other. Seal 80 sits on component 74 and seal 82 sits on component 78. Ring 70 is between components 74 and 76 and ring 72 is between components 76 and 78. One travel stop is affected when sleeve 84 contacts top sub 86 as seen by comparing FIGS. 3 and 4. At the other end sleeve 88 runs into an unseen component to act as a second travel stop. As in the FIGS. 1 and 2 embodiment the operation of an individual ring 70 or 72 is the same. For example, for setting, shoulders 90 and 94 respectively push oppositely oriented segments 92 and 96 toward each other. Segments 92 and 96 can also optionally serve as slips if they have wickers 98 and 100 on their respective external faces. For release, components 76 and 78 are pulled apart by a release tool (not shown) which results in radially extending tabs 102 in openings 104 in segments 92 pulling on those segments to move segments 92 with respect to oppositely oriented segments 96 so that the diameter of the ring 72 is positively pulled down to a smaller dimension so that removal from a surrounding tubular (not shown) is made possible. Those skilled in the art will see that the rings 72 and 70 work on the same principle and that the system is modular and can accommodate as many rings as desired. Wickers on the exterior face of any ring are an option for doing double duty as slips. Even within a given ring some components can have wickers while others do not. Note that in the FIG. 1 embodiment where a single ring of segments 30 and 34 are used, both segments 30 and 34 have openings for radially extending members 26 or 106 so that the segments can be pulled apart for release. In the modular design of FIGS. 3 and 4 only segments 92 in ring 72 are shown with radially extending members through openings to exert a force for release but the invention contemplates that all wedge shaped segments that make up a ring can have the openings through which the oppositely oriented segments are pulled to the lower diameter for removal.

Those skilled in the art will appreciate that the preferred location of the backup assembly that can also function as a slip assembly is between sealing elements. When done in that manner, any added force from well pressures does not add to the stress on the surrounding tubular at the location where it is gripped by the wickers on the ring components. The preferred design provides a positive applied force to the opposed segments through an opening in the segments to move them relatively to each other to the smaller diameter position. The use of angled flats toward which the segment noses move creates a very small clearance adjacent a sealing element that is located between the flat ends of the oppositely oriented segments that sit against a radial surface. As a result, going around for 360 degrees, there is either no place for the seal material to be extruded or there is an array of segment noses with undercuts that run parallel to a tapered flat on the mandrel portion to present a very small clearance that has the effect of retaining the seal material against extrusion. The nose are made or machined to a rounded shape so that even if they abut the end of a sealing element, there will not be damage or any tearing of the sealing element.

While the preferred placement of the backup assembly is between sealing elements, other arrangements can be used such as putting the backup assembly on one or both ends of a sealing element and in a position of exposure to well pressures and fluids. The segments in the ring or rings that make up the backup assembly used in these locations can also be equipped with wickers and perform a double duty as a backup assembly providing circumferential anti-extrusion protection for an adjacent sealing element as well as an anchor for that tool. Other tools that need a backup or protection from extrusion of components when subjected to well pressure when set are also contemplated to be within the scope of the invention.

Figure 6:
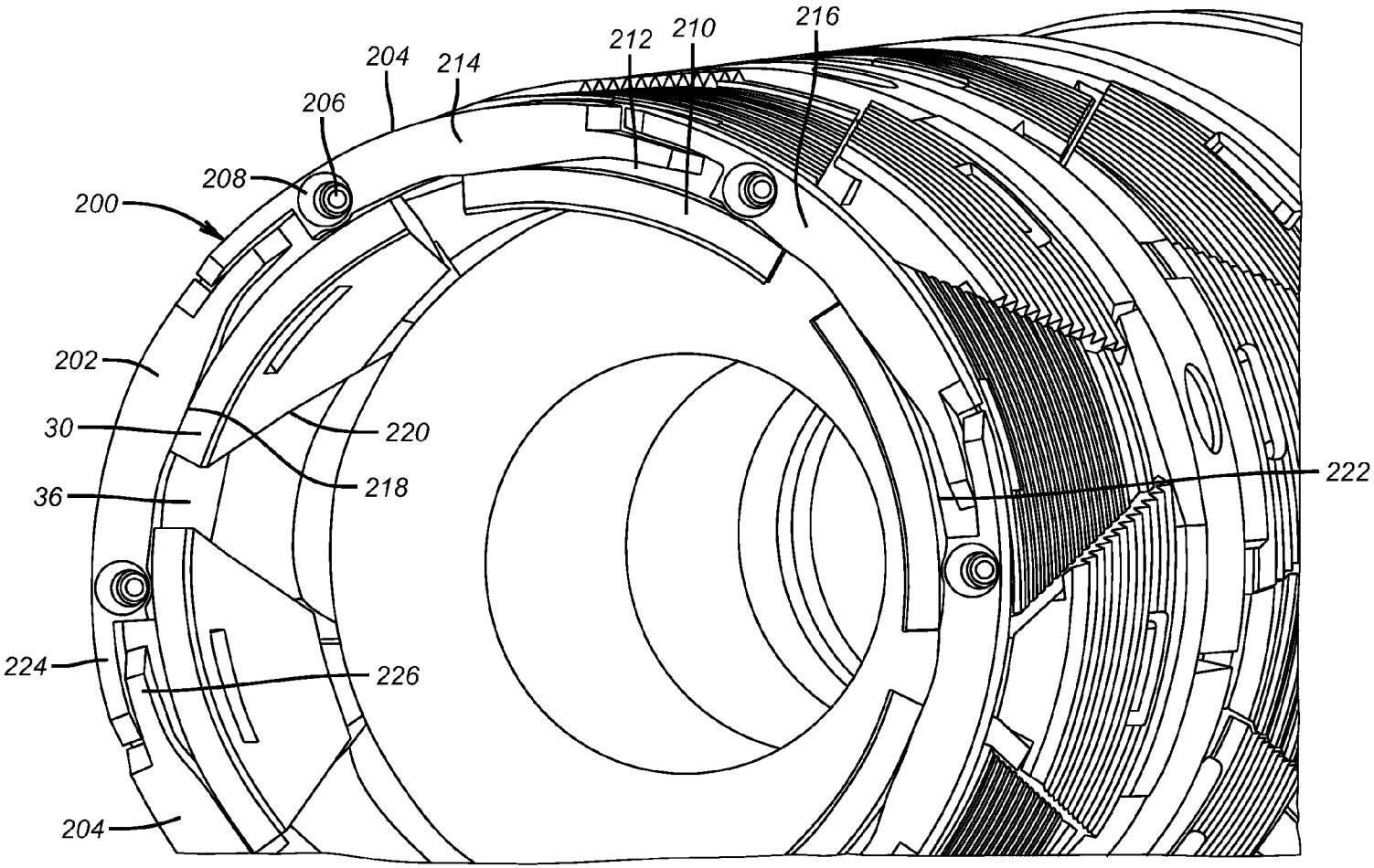
FIG. 6 is an alternative embodiment using the segmented ring for an extrusion barrier between the slip housing and the slip wedge ring shown in the run in position (without showing the slip housing)
Figure 7:
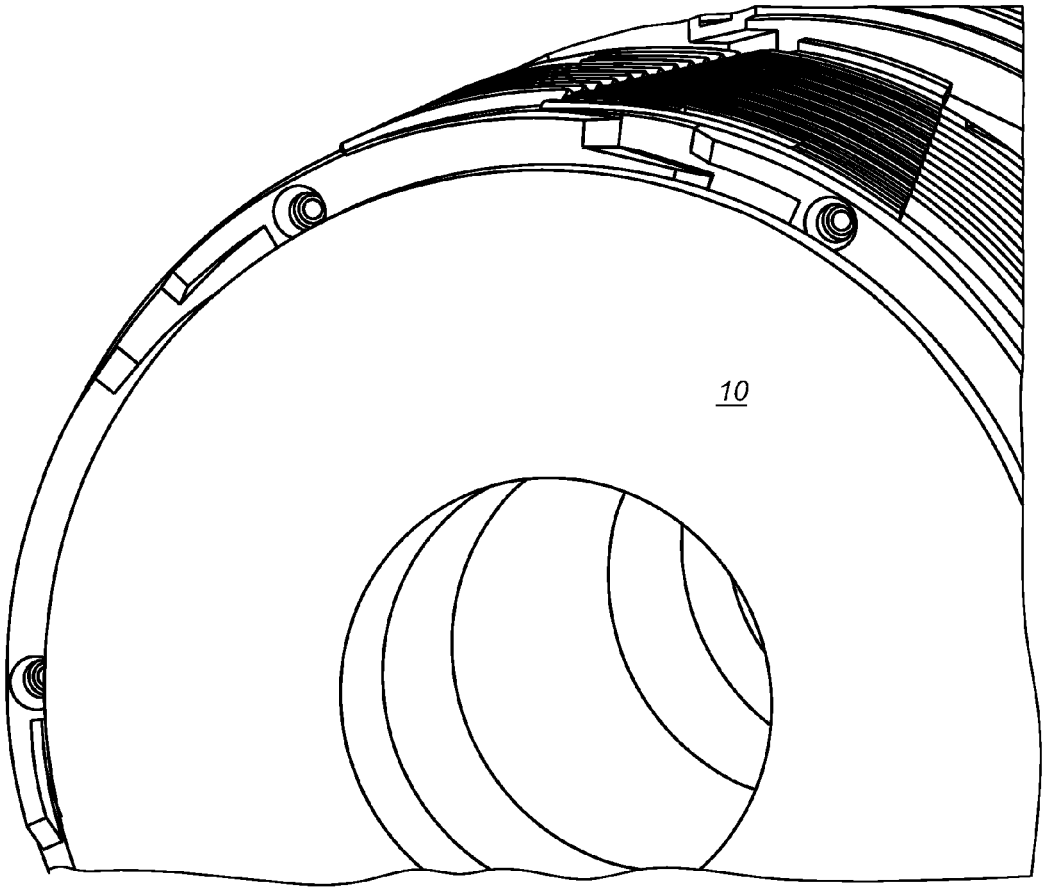
FIG. 7 is the view of FIG. 6 with the backup ring segments against the slip housing in the set position of the wedge slip ring.
Figure 8:
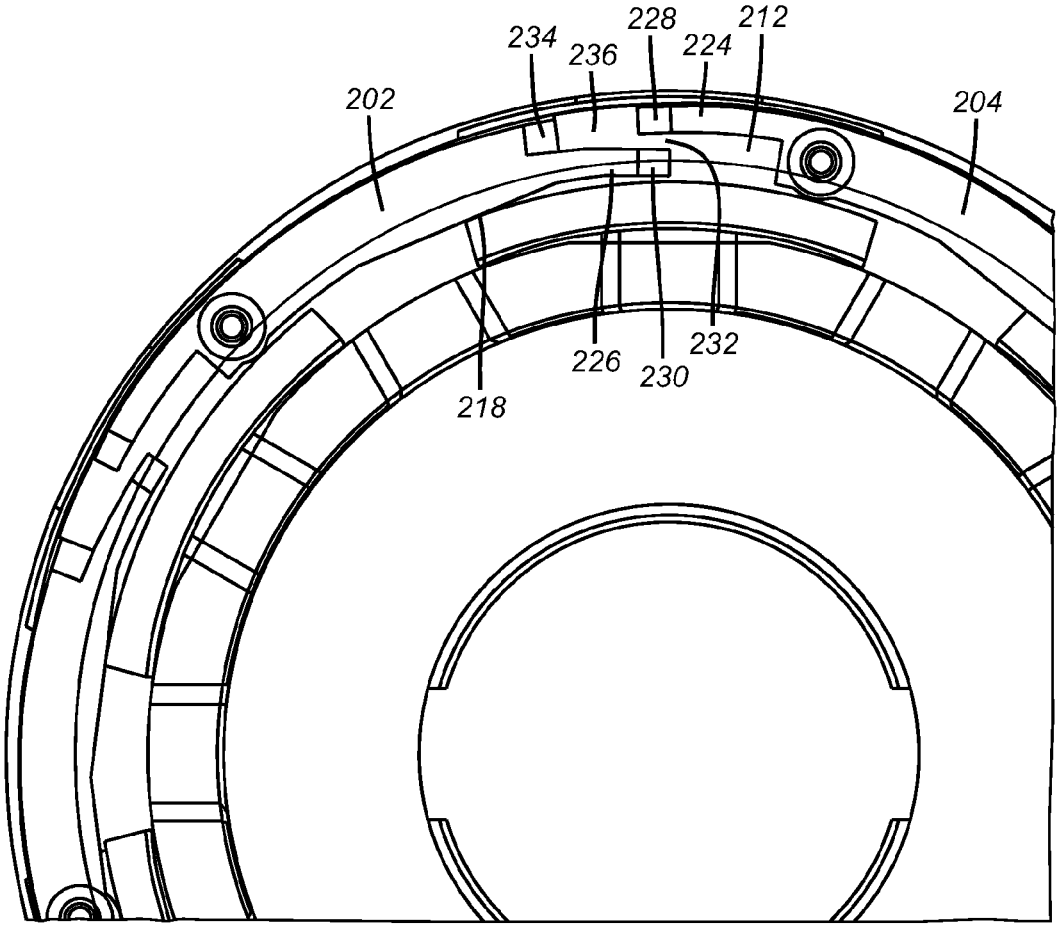
FIG. 8 is the view of FIG. 7 but in plan in the set position looking through the slip housing and showing how the wedge segments rotate the backup ring segments for the set position.
Figure 9:
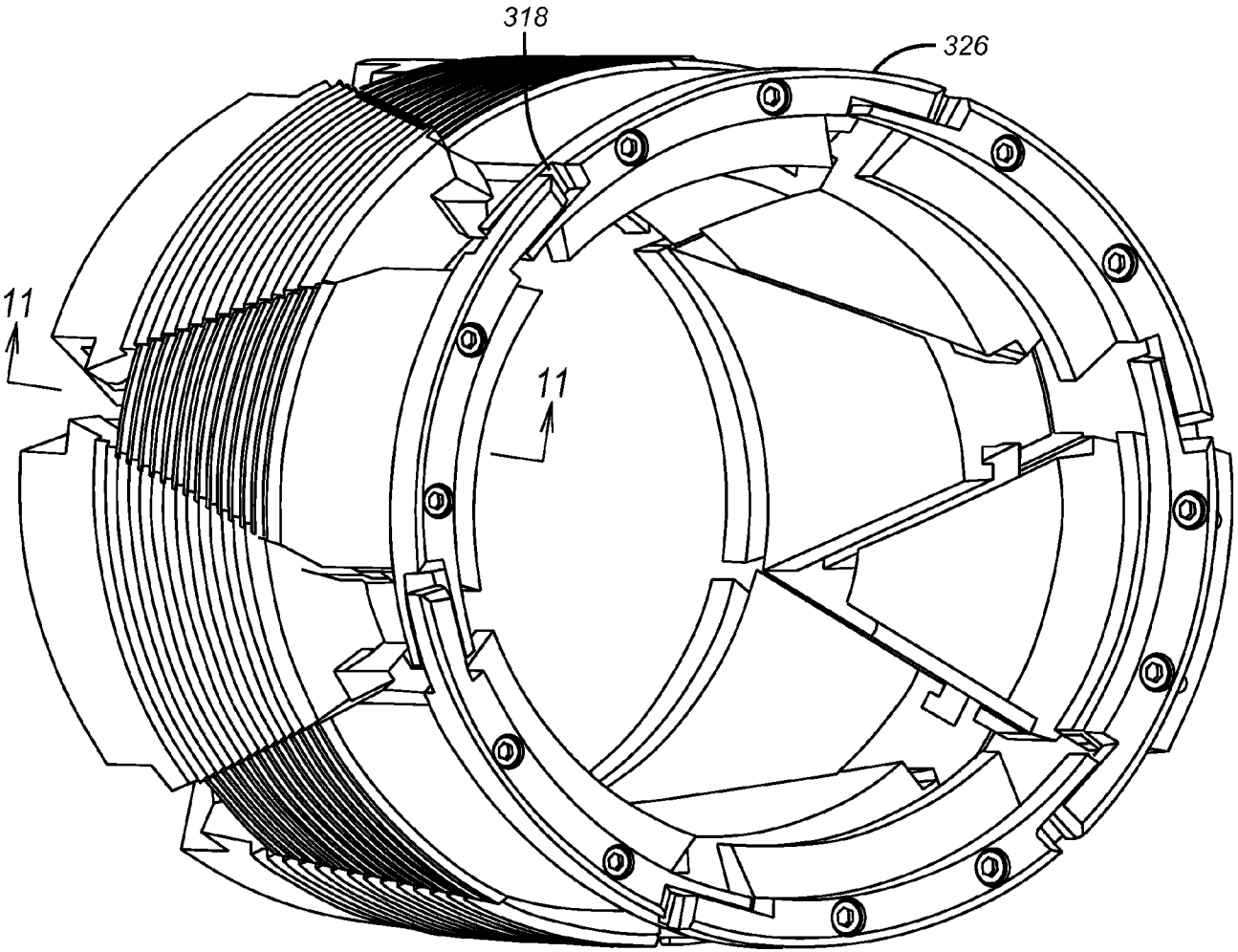
FIG. 9 is an alternative to the view in FIG. 6 and shown in the run in position where the backup ring segments cannot pivot with respect to the wedge segment to which they are attached with spaced fasteners.
Figure 10:
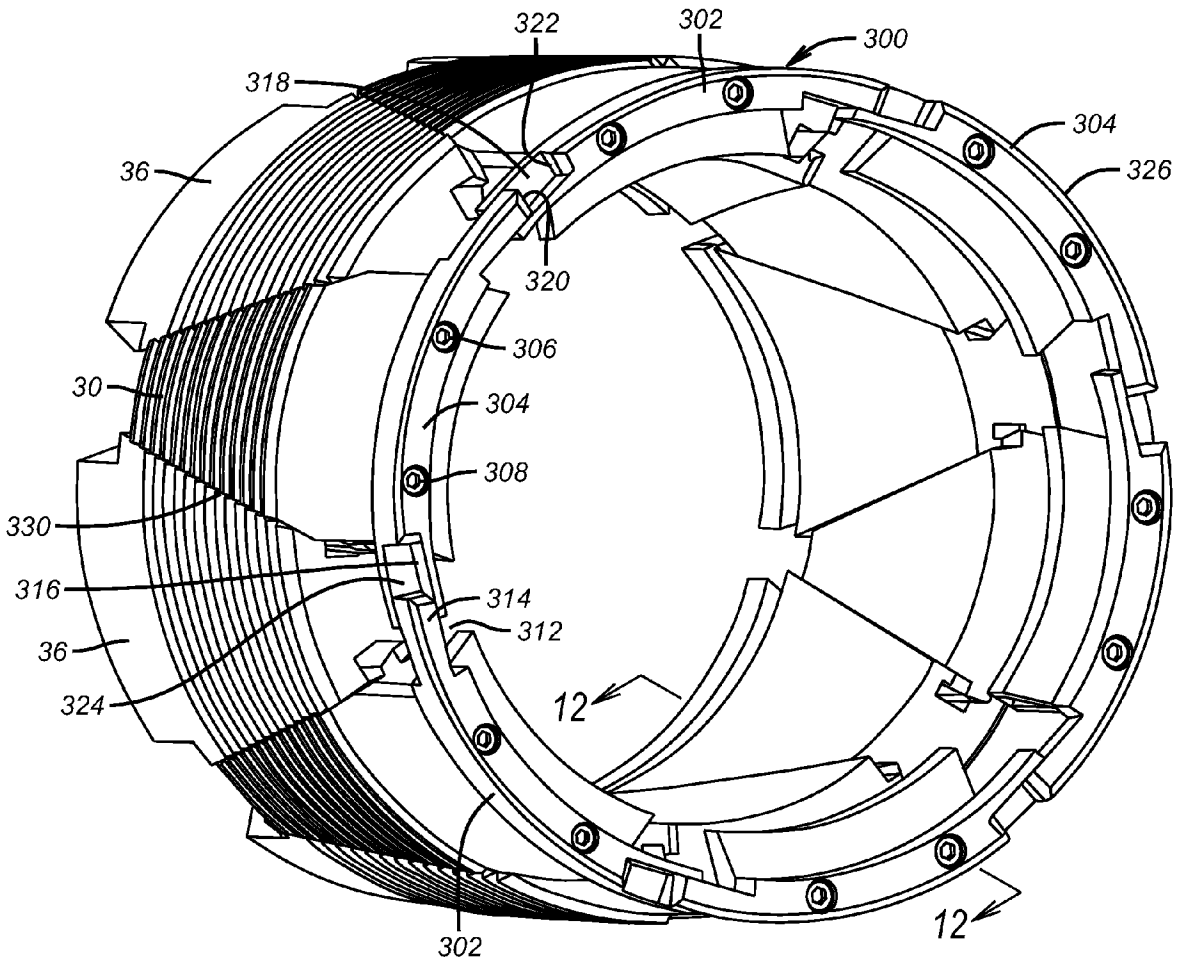
FIG. 10 is the view of FIG. 9 but in the set position showing the backup ring segments moved out with the wedge slip segments.
Figure 11:
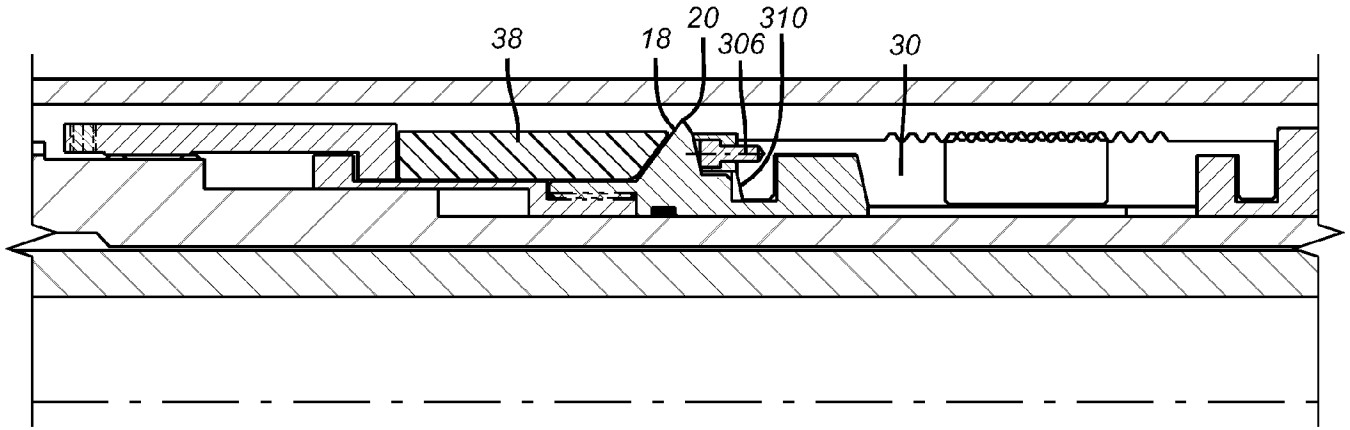
FIG. 11 is a view along lines 11-11 of FIG. 9.

In an alternative embodiment that has several variations, an objective is to isolate a seal such as 38 in FIG. 2 from the pockets such as 52 that open up in the set position when surface 54 moves away from the seal 38. The same condition appears near seal 40 as segments 34 move away from seal 40 except that the gap near seal 40 is circumferentially offset from the gaps 52 adjacent seal 38. FIGS. 6-8 interpose a segmented barrier ring 200 that has individual components such as 202 and 204 at a location adjacent the pushing surfaces 20 and 48 shown in FIG. 1. Each segment 202 and 204 is, at the end shown in FIG. 6, attached to a wedge slip segment such as 30 in FIG. 2 by a fastener 206 in a countersunk hole 208. Each wedge segment 30 has a top surface 210 and an adjacent lower surface 212. Each ring segment 202 and 204 is secured by fastener 206 to the surface 212. The top surfaces 214 and 216 of the ring segments 202 and 204 are preferably flush with the top surfaces 210 of the slip wedge segments 30. Each segment 202 and 204 can preferably pivot about the fastener 206. The pivoting action can come about as the wedge segments 30 and 36 move axially relative to each other along edge dovetails such as 220. As the diameter of the ring made up of wedge segments 30 and 36 grows, an inside surface 218 on ring segments 202 and 204 comes up against surface 222 on an adjacent wedge segment 30. The fastener 206 provides some rotational moment and the contact point between inside surface 218 and surface 222 slides relative to the diameter change of wedge components 30 and 36.

The assembly of the components that make up the barrier ring 200 have gaps between the segments 202 and 204 that allow the diameter of the ring 200 to increase or decrease. These gaps or breaks occur over surfaces 212 to avoid the edge dovetails 220 that exit at the edges of the segments 30 where the narrow end of segments 36 is disposed. The idea is to use the surface 212 to close off an extrusion path for the adjacent seal such as 38. Adjacent ends of ring segments 202 and 204 have offset narrow projections 224 and 226 to maintain the continuity of the barrier ring 200 in the run in and the set positions. These projections continue to circumferentially overlap in the set position of FIG. 7 or 8. There are leading tapers 228 and 230 on the projections 224 and 226 respectively. These tapers are used to move any rubber that has advanced against surface 212 out of the way when it is time to move the segments 202 and 204 closer to each other. The surface 218 that induces the pivoting motion of the segments 202 and 204 about their respective fastener connection keeps the gap 232 between the tapers 228 and 230 to a minimum.

Preferably the wickers on the segments 30 or 36 engage the surrounding tubular in a way that lets the barrier ring 200 come close or engage the surrounding tubular in the set position of FIG. 7 or 8. When a mandrel component such as 10 in FIG. 7 pushes against the top surfaces 210 seen in FIG. 6 and the barrier ring 200 grows in diameter to come close to or contact the surrounding tubular there is little to no gap at the tubular wall for extrusion of the seal such as 38. Importantly, the access of the seal 38 to relatively moving edges of the wedge segments 30 and 36 is blocked as the ring segments 202 and 204 overlie that transition zone between adjacent wedge segments 30 and 36 at the periphery near the surrounding tubular wall and the pushing surface such as 20 shown in FIG. 1 overlays the ends of the wedge segments 30 and 36 further radially inward of the barrier ring 200.

It should be noted that in the design of FIGS. 6-8 the bevels 22 and 50 shown in FIG. 1 are optional and can be omitted. While this design embodiment has been discussed with respect to one side of a ring of wedge segments 30 and 36, those skilled in the art will appreciate that the opposite side with respect to a seal 40 can also be used if oriented in minor image. The difference will be that the fixation with a fastener will be into the wide portion of segments 36 instead of segments 30 as described for the opposite end and shown in FIGS. 6-8.

A ramp 234 can be located on ring segment 202 opposite ramp 228 to push out rubber of seal 38 that had advanced into a space 236 defined between ramps 228 and 236 and above the surface 212 on the wedge segments 30.

Figure 12:
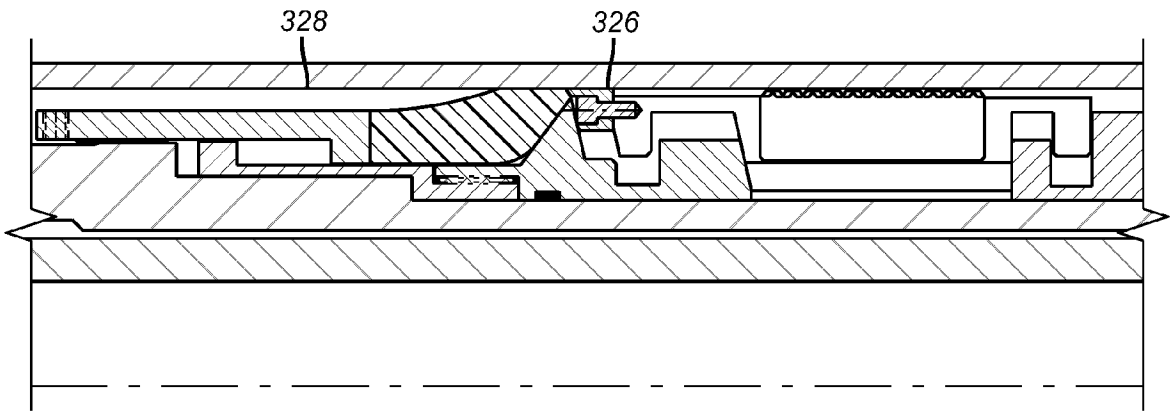
FIG. 12 is a view along lines 12-12 of FIG. 10.

FIGS. 9-12 show a slightly different design. There is a segmented barrier ring 300 made of segments 302 and 304. There are spaced apart fasteners 306 and 308 that go into top surface 310 of the wedge segments 30. As a result there is no relative rotation as between the segments 302 and 304 and the wedge slip 30 to which each is secured. The segment 302 has an undercut 312 and an adjacent end segment 314 that has a square or rectangular cross-section. Segment 304 has an 1-shaped cutout 316 to accept the segment 314 as the diameter of the ring 300 changes. Gap 318 between surfaces 320 and 322 opens in the set position but that gap has a bottom at surface 324 on segment 304. In the set position, the ring outer dimension 326 comes close to or into contact with the surrounding tubular 328 as shown in FIG. 12. Despite some small gaps 324 in the outer dimension 326, those gaps are of minimal volume due to the overlapping nature of the segments 302 and 304 at the gap locations. This feature allows the location of the transition between segments 302 and 304 to be over the wedge segments 36 and the edge dovetails 330 since the outer dimension 326 goes to the tubular wall 328 results in isolation of the dovetail regions 330 from rubber or other material of seal 38 that is trying to extrude in that direction. Preferably the ends of the segments 302 and 304 stay in contact adjacent segments 314 as the diameter of the barrier ring 300 increases or decreases.

As an alternative the barrier rings 200 or 300 can be made of a single piece split ring where the opposed ends have details as described above. Using a split ring will eliminate the pivoting feature described with respect to barrier ring 200 but the one piece design would in other respects function the same way.

The above description is illustrative of the preferred embodiment and many modifications may be made by those skilled in the art without departing from the invention whose scope is to be determined from the literal and equivalent scope of the claims below:

We claim:

1. A backup assembly for a seal on a downhole tool in a wellbore defined by a wall, comprising:

at least a first and second relatively movable mandrel components;

at least one seal mounted on at least one mandrel component;

a plurality of connected wedge shaped segments mounted to said mandrel components and having a wide end and a nose at an opposite end arranged into at least one wedge ring shape and selectively relatively movable to change the diameter of said ring with radial growth toward the wall;

a barrier ring comprising at least one ring segment movable with said wedge ring toward the wall, said barrier ring presenting a barrier adjacent the wall for said seal.

2. The assembly of claim 1, wherein:

said barrier ring comprises a split ring with a split that changes in dimension as said ring moves toward the wall.

3. The assembly of claim 2, wherein:

said barrier ring is secured to at least one wedge shaped segment and said split is disposed over a wide end of at least one wedge segment.

4. The assembly of claim 3, wherein:

said barrier ring forms a 360 degree barrier in conjunction with at least one wide end of at least one wedge segment that is adjacent said split.

5. The assembly of claim 2, wherein:

said split comprises ends of said ring that overlap each other as the diameter of said ring changes.

6. The assembly of claim 5, wherein:

said split is located over a nose of a wedge shaped segment;

said ring secured at at least one location to at least one wide end of at least one wedge segment.

7. The assembly of claim 6, wherein:

said ring engages the wall when said wedge ring diameter is increased to act as an extrusion barrier to said seal when said seal is compressed against the wall.

8. The assembly of claim 4, wherein:

said ring engages the wall when said wedge ring diameter is increased to act as an extrusion barrier to said seal when said seal is compressed against the wall.

9. The assembly of claim 1, wherein:

said barrier ring comprising multiple ring segments that overlap adjacent ring segments at opposed ends of each ring segment with each ring segment secured to a wedge shaped segment.

10. The assembly of claim 9, wherein:

each ring segment is secured at a single location to a wide end of a wedge segment so that the ring segment can pivot about said single location as the diameter of said barrier ring changes.

11. The assembly of claim 9, wherein:

ends of adjacent ring segments overlay a wide end of a wedge segment.

12. The assembly of claim 11, wherein:

ends of adjacent ring segments overlap each other in a radial direction while moving toward or away from each other circumferentially as said barrier ring changes dimension.

13. The assembly of claim 12, wherein:

each ring segment is secured pivotally to one wide portion of a wedge segment and has one end extending to an adjacent wide end of another wedge segment.

14. The assembly of claim 13, wherein:

said ring segments and said wide portion of said wedge segments that underlie said ends of said ring segments present a 360 degree barrier to extrusion of said seal.

15. The assembly of claim 14, wherein:

said barrier ring engages the wall when the diameter of said wedge ring is increased.

16. The assembly of claim 12, wherein:

said ends have a leading sloping surface to displace any portion of said seal, which has moved between said ends when said seal engages the wall, away from said wide end of an underlying wedge segment to facilitate said ends moving toward each other as the diameter of said barrier ring is reduced.

17. The assembly of claim 9, wherein:

each ring segment is secured at multiple locations to a wide end of a wedge segment so that the ring segment cannot pivot about said wedge segment as the diameter of said barrier ring changes.

18. The assembly of claim 9, wherein:

ends of each ring segment extend beyond opposed ends of said wide end of a wedge segment to which the ring segment is secured.

19. The assembly of claim 9, wherein:

ends of adjacent ring segments overlap each other circumferentially as said barrier ring changes diameter so that said barrier ring remains continuous for 360 degrees.

20. The assembly of claim 19, wherein:

said barrier ring moves into contact with the wall as said wedge ring diameter increases to retain said seal that is also compressed against the wall.

21. The assembly of claim 4, wherein:

said wedge ring has wickers that engage the wall to support said mandrel components.

22. The assembly of claim 9, wherein:

said wedge ring has wickers that engage the wall to support said mandrel components.

* * * * *